United States Patent [19]

Foucher et al.

[11] Patent Number: 4,697,634

[45] Date of Patent: Oct. 6, 1987

[54] DEVICE FOR FIXING A PERFORATED SHEET AGAINST THE PERFORATED TUBE PLATE OF A HEAT EXCHANGER

[75] Inventors: Jean-Claude Foucher, Bagneux; Pierre Devoucoux, Suresnes, both of France

[73] Assignee: Stein Industrie, Velizy Villacoublay, France

[21] Appl. No.: 25,050

[22] Filed: Mar. 12, 1987

[30] Foreign Application Priority Data

Mar. 14, 1986 [FR] France ..... 86 03692

[51] Int. Cl.[4] ..... F28F 9/02

[52] U.S. Cl. ..... 165/76; 165/174; 122/406 B

[58] Field of Search ..... 165/76, 174; 122/406 B

[56] References Cited

U.S. PATENT DOCUMENTS

| | | | |
|---|---|---|---|
| 130,842 | 8/1872 | Butler | 165/174 |
| 2,143,477 | 1/1939 | Dillon et al. | 165/174 X |
| 2,164,629 | 7/1939 | Sibley | 285/203 |
| 2,484,904 | 10/1949 | Pennella | 165/76 X |
| 3,563,303 | 2/1971 | Gilli et al. | 165/1 |
| 3,707,186 | 12/1972 | Zorrilla et al. | 165/174 X |
| 4,133,184 | 1/1979 | Bivins, Jr. | 165/174 X |
| 4,607,689 | 8/1986 | Mochida et al. | 165/174 X |

FOREIGN PATENT DOCUMENTS 1172604 2/1956 France .

*Primary Examiner*—Albert W. Davis, Jr.
*Assistant Examiner*—Richard R. Cole
*Attorney, Agent, or Firm*—Sughrue, Mion, Zinn, Macpeak & Seas

[57] ABSTRACT

A device for fixing a perforated sheet (8) against the perforated tube plate (1) of a heat exchanger having a bundle of tubes (4, 5), the perforated sheet (8) controlling the rate of fluid flow along the tubes, and the device comprising hollow pins (10) inserted in the ends of some of the tubes (4) and expanded therein, the hollow pins terminating outside the tubes with threaded ends (12) onto which respective nuts (15) are screwed for clamping the perforated sheet against the perforated tube plate, the nuts having heads including respective axial fluid-flow controlling bores (17).

2 Claims, 1 Drawing Figure

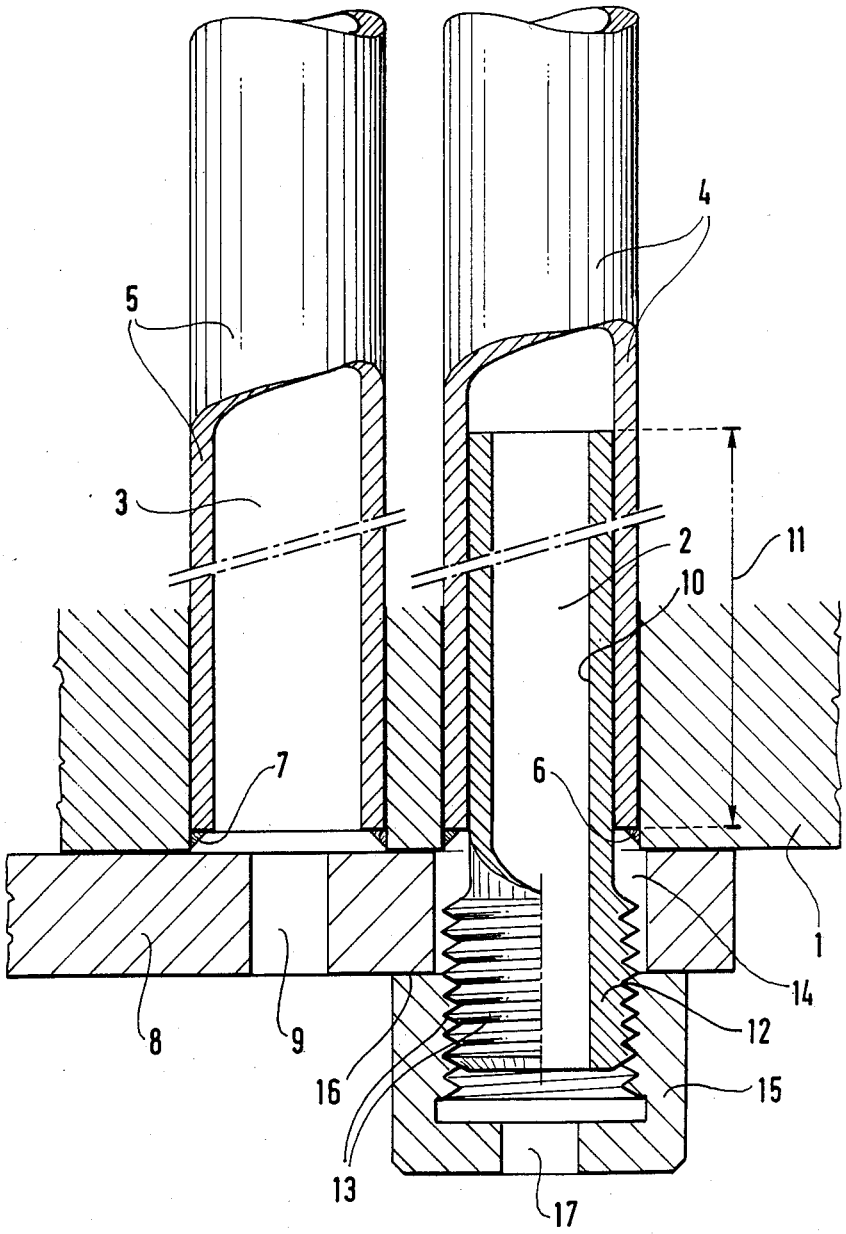
4
5
3
2
11
10
7
6
1
14
12
8
9
16
15
13
17

DEVICE FOR FIXING A PERFORATED SHEET AGAINST THE PERFORATED TUBE PLATE OF A HEAT EXCHANGER

The present invention relates to a device for fixing a perforated sheet against a perforated tube-supporting plate at one end of a bundle of tubes in a heat exchanger in order to control the rate of fluid flow along the tubes.

BACKGROUND OF THE INVENTION

It is sometimes desirable to adjust the rate at which fluid enters the tubes of a heat exchanger, either to have some tubes with a higher flow rate than others, or else to make the flow rate as uniform as possible over the various the tubes, taking account of flow conditions which tend to cause more fluid to flow from the feed chamber into some tubes than in to others.

Proposals have already been made to provide such fluid rate control by placing a relatively thin sheet against the perforated tube plate with said sheet having holes which are smaller in diameter than the holes through the perforated tube plate and which are disposed at the same locations. The fluid feeding the tubes of the bundle is thus constrained to pass through the smaller holes of the sheet prior to entering the tubes. In order to prevent fluid from flowing in the space between the tube plate and the sheet, which could give rise to unequal flow rates, the sheet must be clamped firmly against the face of the tube plate. Further, the clamping member(s) must be suitable for easy disassembly in order to provide access to the welds between the tubes in the bundle and the tube plate, whenever inspection or repair is necessary.

Given the diameter and the closeness of the holes through the tube plate, there is not enough room to install pins or screws in the tube plate for fixing the perforated sheet therto. Further, if the fixing means are installed in such a way as to block some of the holes through the tube plate, then the number of active tubes in the heat exchanger bundle is reduced.

The present invention seeks to provide a fixing device for fixing a perforated sheet against the perforated tube plate in order to control the rate of fluid flow along said tubes, said fixing device avoiding blocking any of the holes through the tube plate while nevertheless being easily disassembled in order to provide access to said holes.

SUMMARY OF THE INVENTION

The present invention provides a device for fixing a perforated sheet against the perforated tube plate of a heat exchanger having a bundle of tubes, said perforated sheet controlling the rate of fluid flow along said tubes, and said device comprising hollow pins inserted in the ends of some of the tubes and expanded therein, said hollow pins terminating outside said tubes with threaded ends onto which respective nuts are screwed for clamping the perforated sheet against the perforated tube plate, said nuts having heads including respective axial fluid-flow controlling bores.

Preferably the axial bore through each nut is smaller in diameter than the inside diameter of the corresponding hollow pin, and of such a size as to provide the desired head loss at the inlet to the tube in which the pin is inserted.

BRIEF DESCRIPTION OF THE DRAWING

An embodiment of the invention is described by way of example with reference to the sole FIGURE of the accompanying drawing which is a partial section through a fixing device in accordance with the invention.

MORE DETAILED DESCRIPTION

The perforated tube plate 1 of a heat exchanger has holes such as 2 and 3 which receive the ends of tubes such as 4 and 5, with the tips of the tubes being welded to the tube plate by weld fillets such as 6 and 7. A perforated sheet 8 having holes such as 9 therethrough is clamped against the tube plate by means of a plurality of fixing members, only one of which is shown in the drawing.

The fixing member shown comprises a tubular pin 10 which is expanded against the inside wall of a corresponding tube 4 over a zone 11, with the pin terminating in a head 12 having an external thread 13. The head 12 is received in a hole 14 through the perforated sheet which is of larger diameter than the holes 9 therethrough. A nut 15 having a complementary inside thread is screwed onto the head 12 and the leading face 16 of the nut 15 clamps the sheet against the plate.

The nut has a head with an axial bore 17 therethrough, the diameter of said bore 17 being smaller the inside diameter of the pin, and being equal to one of the normal holes 9 through the perforated sheet. It can thus be seen that the fixing device makes it impossible to fluid to flow between the perforated sheet and the tube plate while ensuring that the same flow rate is provided along a normal tube 5 and along a tube 4 fitted with a member for fixing the perforated sheet.

A fixing device in accordance with the invention is particularly applicable to the tube plates of heat exchangers having bundles of tubes and installed in separator-superheater apparatuses for steam expansion turbines in electricity power generating stations.

What is claimed:

1. A device for fixing a perforated sheet against the perforated tube plate of a heat exchanger having a bundle of tubes, said perforated sheet controlling the rate of fluid flow along said tubes, and said device comprising hollow pins inserted in the ends of some of the tubes and expanded therein, said hollow pins terminating outside said tubes with threaded ends onto which respective nuts are screwed for clamping the perforated sheet against the perforated tube plate, said nuts having heads including respective axial fluid-flow controlling bores.

2. A device according to claim 1, wherein the axial bore through each nut is smaller in diameter than the inside diameter of the corresponding hollow pin, and of such a size as to provide the desired head loss at the inlet to the tube in which the pin is inserted.

* * * * *